US009874014B2

(12) United States Patent
Reed, II et al.

(10) Patent No.: US 9,874,014 B2
(45) Date of Patent: Jan. 23, 2018

(54) METAL TO FRAME STRUCTURAL INSULATED PANEL ($M^2$SIP)

(71) Applicants: Henry Vernon Reed, II, Hawthorne, CA (US); Nancy Suzanne Hardon, Hutchinson, KS (US)

(72) Inventors: Henry Vernon Reed, II, Hawthorne, CA (US); Nancy Suzanne Hardon, Hutchinson, KS (US)

( * ) Notice: Subject to any disclaimer, the term of this patent is extended or adjusted under 35 U.S.C. 154(b) by 42 days.

(21) Appl. No.: 14/821,486

(22) Filed: Aug. 7, 2015

(65) Prior Publication Data

US 2016/0145866 A1 May 26, 2016

Related U.S. Application Data

(60) Provisional application No. 62/123,496, filed on Nov. 20, 2014.

(51) Int. Cl.

| | |
|---|---|
| ***E04C 2/52*** | (2006.01) |
| ***E04C 2/296*** | (2006.01) |
| ***E04B 2/00*** | (2006.01) |
| *E04C 2/00* | (2006.01) |

(52) U.S. Cl.

CPC ..... *E04C 2/521* (2013.01); *E04C 2/296* (2013.01); *E04C 2/46* (2013.01); *E04C 2002/001* (2013.01)

(58) Field of Classification Search

None

See application file for complete search history.

(56) References Cited

U.S. PATENT DOCUMENTS

| | | | | |
|---|---|---|---|---|
| 5,713,176 | A * | 2/1998 | Hunt | E04B 2/789 52/376 |
| 5,842,276 | A * | 12/1998 | Asher | B26D 1/553 264/142 |
| 6,061,995 | A * | 5/2000 | Menchetti | E04B 2/7411 52/481.1 |
| 6,993,883 | B2 * | 2/2006 | Belanger | E04B 2/7457 52/847 |
| 8,820,033 | B2 * | 9/2014 | Yang | E04C 3/17 29/428 |
| 2001/0002529 | A1 * | 6/2001 | Commins | E04B 1/26 52/481.1 |

(Continued)

*Primary Examiner* — Elizabeth A Quast

(74) *Attorney, Agent, or Firm* — Los Angeles Patent Group; Arman Katiraei

(57) ABSTRACT

The panel, a new build process using a steel channel frame outer band. It is joined with wood framing studs, screwed into the outer band for durability and stability. The panel's vertical studs provide strength during the manufacturing process. All panels are combined with one Universal Receptacle, a metal utility box supporting electrical, water lines securing the panel base structure to concrete. The box is also used to mate panel-to-panel. The panels are joined internally with expanded polystyrene foam for soundproofing and thermal insulation protection. The panel's outer covering is oriented strand board, secured to the front and back of the finished product. In the lower right side front oriented strand board, a pre-cut beveled slot is used to provide for electrical wiring, water lines and also secures the panel to the foundation. All panel components are constructed identically in depth, height, and can be configured into any floor plan.

10 Claims, 7 Drawing Sheets

(56) References Cited

U.S. PATENT DOCUMENTS

| | | | | |
|---|---|---|---|---|
| 2002/0144833 | A1* | 10/2002 | Russell | H02G 3/386 174/504 |
| 2004/0068947 | A1* | 4/2004 | Commins | E04B 1/10 52/293.3 |
| 2008/0178542 | A1* | 7/2008 | Williams | H02G 3/0493 52/220.7 |
| 2011/0041449 | A1* | 2/2011 | Espinosa | E02D 35/00 52/698 |
| 2012/0011805 | A1* | 1/2012 | Yang | B32B 15/10 52/834 |
| 2013/0019549 | A1* | 1/2013 | Henriquez | E04B 1/14 52/220.2 |
| 2015/0093535 | A1* | 4/2015 | Lambach | E04C 2/386 428/71 |

* cited by examiner

Exploded View

Cut Corner View

OSB Beveled Slot Cover - Cut Corner View

Side View

Side View

Integrated Side View

METAL TO FRAME STRUCTURAL INSULATED PANEL ($M^2$SIP)

FIELD OF INVENTION

This invention relates to a building construction assembly process. It incorporates a metal framing system into a structural insulated panel, and incorporates a minor subsystem connection, in strengthening the structural wall. By allowing the metal framing to be incorporated, and improving the connection of structural insulated panel building component, the user will realize significant strength, durability and cost savings. The Metal to Frame Structural Insulated Panels (M2SIP) can be sold as alternative components for the housing industry.

BACKGROUND OF THE INVENTION

Structural Insulated Panels (SIPs) have been questioned by potential homeowners who have doubts about the integrity and durability of this product. The current Structural Insulated Panels (SIPs) building process does not integrate a lot of wood studded materials into the building process. Structural Insulated Panels (SIPs) only include wood studs into the deployment and window framing process. Due to the changing building codes, the Structural Insulated Panels (SIPs) building process has been mandated to include a metal stirrup to be attached from the base of the Structural Insulated Panels (SIPs), to the foundation slab as a safety tie down against high winds and major storms.

Although the Structural Insulated Panels (SIPs) industry has tried to change the image of Structural Insulated Panels (SIPs), future home buyers are considering additional strength and durability in the ever changing weather patterns and ground shifting activity. Structural Insulated Panels (SIPs) manufacturers have made their walls thicker so that future homes meet and exceed initial strength and durability for harsh weather conditions.

SUMMARY OF THE INVENTION

In accordance with the present invention, Metal to Frame Structural Insulated Panels (M2SIP) is a building design process that uses a steel channel frame outer band shell, and is integrated with wood framing studs that are mitered and screwed into the steel channel frame outer band shell to add durability and stability. Metal to Frame Structural Insulated Panels (M2SIP) integrates interior vertical studs to provide strength during the manufacturing process. All Metal to Frame Structural Insulated Panels (M2SIP) are put together with one Universal Receptacle. This is a metal utility box that supports electrical chase and water lines to secure the s base structure into the concrete slab. The Universal Receptacle is also used to incorporate and mate each Metal to Frame Structural Insulated Panels (M2SIP) wall through vertical studs, into another Metal to Frame Structural Insulated Panel (M2SIP). Metal to Frame Structural Insulated Panels (M2SIP) are then combined internally with Expanded Polystyrene (EPS) Foam for soundproofing and thermal insulation protection. The Metal to Frame Structural Insulated Panels (M2SIP) outer covering is Oriented Strand Board (OSB) that is nailed and secured to the front and back of the finished product. In the front, lower right side, the Oriented Strand Board (OSB) has a pre-cut, beveled slot used to include electrical wiring chase and water lines, secured to the Metal to Frame Structural Insulated Panel (M2SIP) foundation, and Metal to Frame Structural Insulated Panel (M2SIP)-to-Metal to Frame Structural Insulated Panel (M2SIP). All Metal to Frame Structural Insulated Panels (M2SIP) components are constructed identically in depth, height and configuration. Each Metal to Frame Structural Insulated Panels (M2SIP) can be configured into any floor plan.

The purpose of the present invention is to provide a durable, structural insulated panel construction processed product to the public that solves future consumers questions of strength and durability.

Another purpose of the present invention is to provide an integrated, fully functional product that meets and exceeds the changing building codes and requirements.

In addition, the present invention provides a product that combines the traditional manufacturing building process and structural insulated panel process together with a new and improved process that improves the structural insulated panel process for the future.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the figures.

DESCRIPTION OF THE PREFERRED EMBODIMENT

Referring to FIGS. 1-7, are illustrated drawing views, which have been constructed in accordance with the present invention Metal to Frame Structural Insulated Panels (M2SIP).

Figure 1:
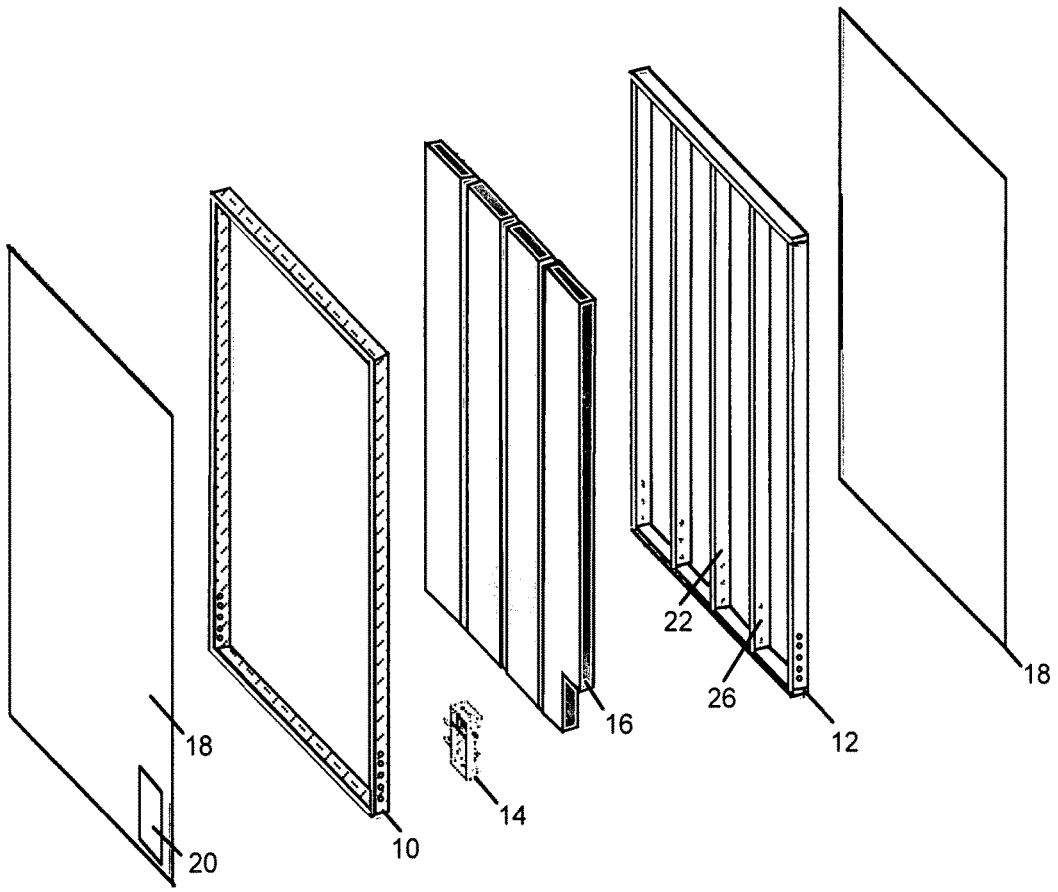
FIG. 1 is a right perspective, exploded view diagram integrated view in the vertical position.

FIG. 1 is a right perspective, exploded view diagram and right cut corner integrated view diagram in the vertical position of the metal to frame structural wall. The steel channel frame (10) provides strength and durability and is key in the manufacturing process of the Metal to Frame Structural Insulated Panel (M2SIP) walls. The metal frame is made of 3⁄16" steel and is form-bent with a small lip, 3⁄8" to hold the bottom/top and side studs of the Metal to Frame Structural Insulated Panels (M2SIP) in place. Each steel channel frame is formed and welded to wrap the outer wood frame (12) and is the backbone of the mating process of the Metal to Frame Structural Insulated Panel (M2SIP) walls.

The Metal to Frame Structural Insulated Panel (M2SIP) top/bottom studs act as the horizontal integration platform to form the body of the structure. Each top/bottom stud is made of yellow material and will be 2"×6"×4'. Each Metal to Frame Structural Insulated Panels (M2SIP) top/bottom stud will be mitered and set inside the Metal to Frame Structural Insulated Panel (M2SIP) metal frame. The vertical wood studs (22) provide internal structural support and durability. The Metal to Frame Structural Insulated Panels (M2SIP) vertical wood studs (22) will be cut and placed according to configuration. The steel channel frame (10) and vertical wood studs (22) will have pre-drilled holes and the metal Universal Receptacle will be mounted and screwed into place. The Universal Receptacle screw mount holes (30) are pre-drilled and will be ready for the Metal to Frame Structural Insulated Panel (M2SIP)-to-Metal to Frame Structural Insulated Panel (M2SIP) mating.

The Metal to Frame Structural Insulated Panels (M2SIP) guide openings are pre-drilled with the use of a Universal Receptacle metal template guide. Each Metal to Frame Structural Insulated Panels (M2SIP) will have five openings that will vary in size and will be drilled through the right side vertical stud and metal frame also the bottom stud and metal frame. The openings in the side will be used a follows: electrical chase hole 1⅜", hot and cold water chase holes 1", and two secure bolt-down holes ⅝". The opening in the bottom will be used to add a base bolt to secure the Metal to Frame Structural Insulated Panel (M2SIP) for mating through the ¾" opening to the base plate.

The exterior Oriented Strand Board (OSB) (18) is glued and nailed to the vertical wood studs (22) and outer wood frame studs (12). Each Metal to Frame Structural Insulated Panel (M2SIP) shall have two Oriented Strand Board (OSB) sheeting, one for the exterior and one for the interior. Each Oriented Strand Board (OSB) sheeting, will be the same in configuration: 7/16" depth, with two different sizes 4'×9', or 8'×9' in length. The sheeting provides adequate build protection and is optimum in the construction of homes.

Non-stick rods will be put into place through the opening holes. Expanded Polystyrene (EPS) Foam (16) is then blown into the open chambers of the Metal to Frame Structural Insulated Panel (M2SIP) walls to provide insulation and sound proofing.

The internal Oriented Strand Board (OSB) (18) is then glued and nailed into place with OSB beveled slot cover (20), faced front and base mount tie down/extra hole (34) is then mounted through the green board stud and into the concrete slab, structural bold hole (26) hardware must be connected to support secure process. Utilities such as electrical chase panel (24), wiring and water chase hole (28) as pre-measured, integrated and deployed into the Metal to Frame Structural Insulated Panel (M2SIP) wall.

Figure 2:
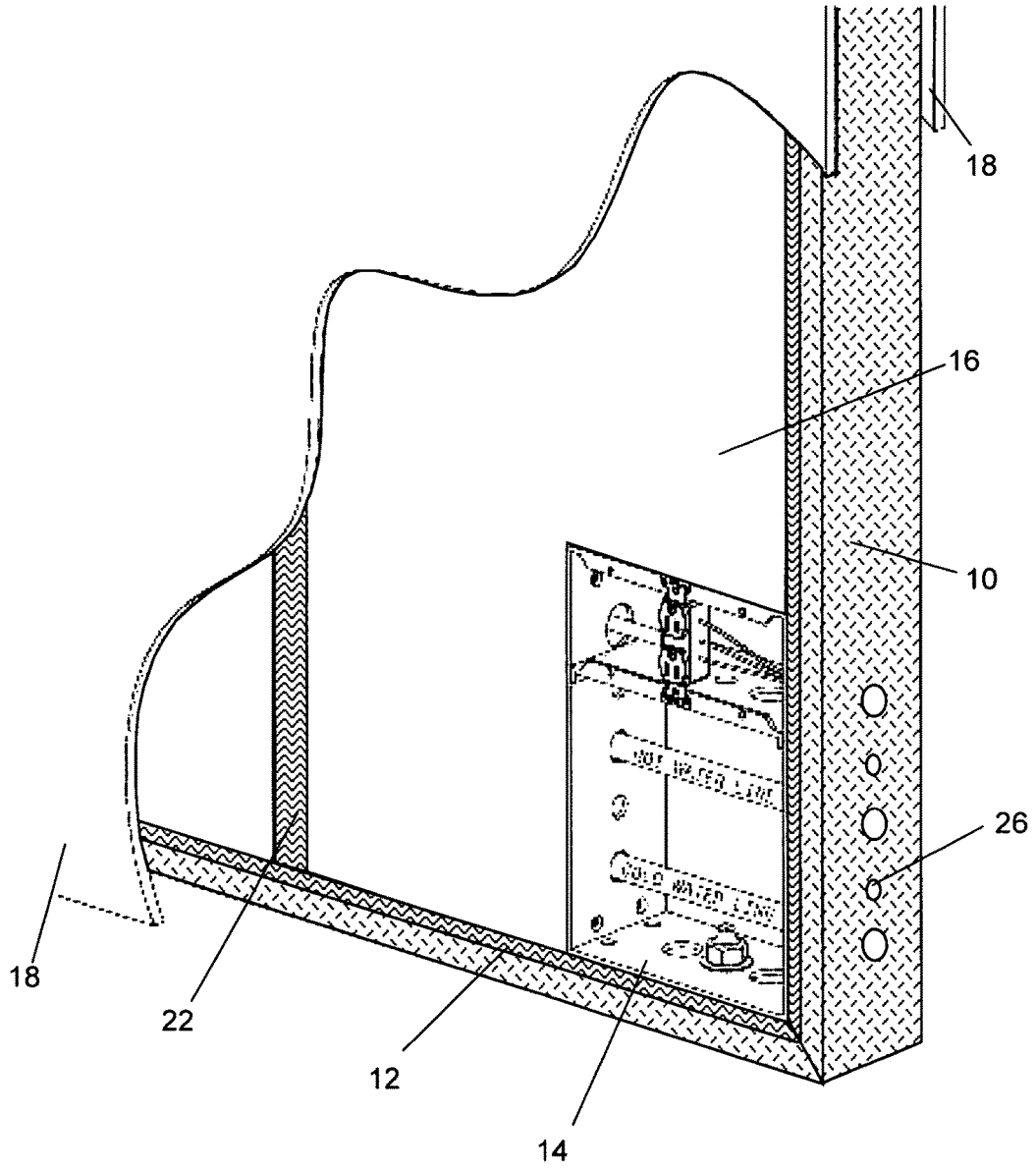
FIG. 2 is a Lower front view of the cut corner view in the vertical position.

FIG. 2 is a Lower right front of the cut corner view in a vertical position provides a detail integrated view of the Metal to Frame Structural Insulated Panel (M2SIP) when it is configured together showing how the framed Metal to Frame Structural Insulated Panel (M2SIP) is integrated with the components and is designed to give the structure strength, durability and stability when building within the steel channel frame (10). Parts and components such as the outer wood frame (12) support the vertical wood studs (22), Universal Receptacle (14) is screw mounted to the lower right inside vertical stud. Expanded polystyrene (EPS) foam (16) material is spray coated as sound proofing and insulation. The Oriented Strand Board (OSB) (18) drawing has been modified to show the internal configuration of the Metal to Frame Structural Insulated Panel (M2SIP) build process.

Figure 3:
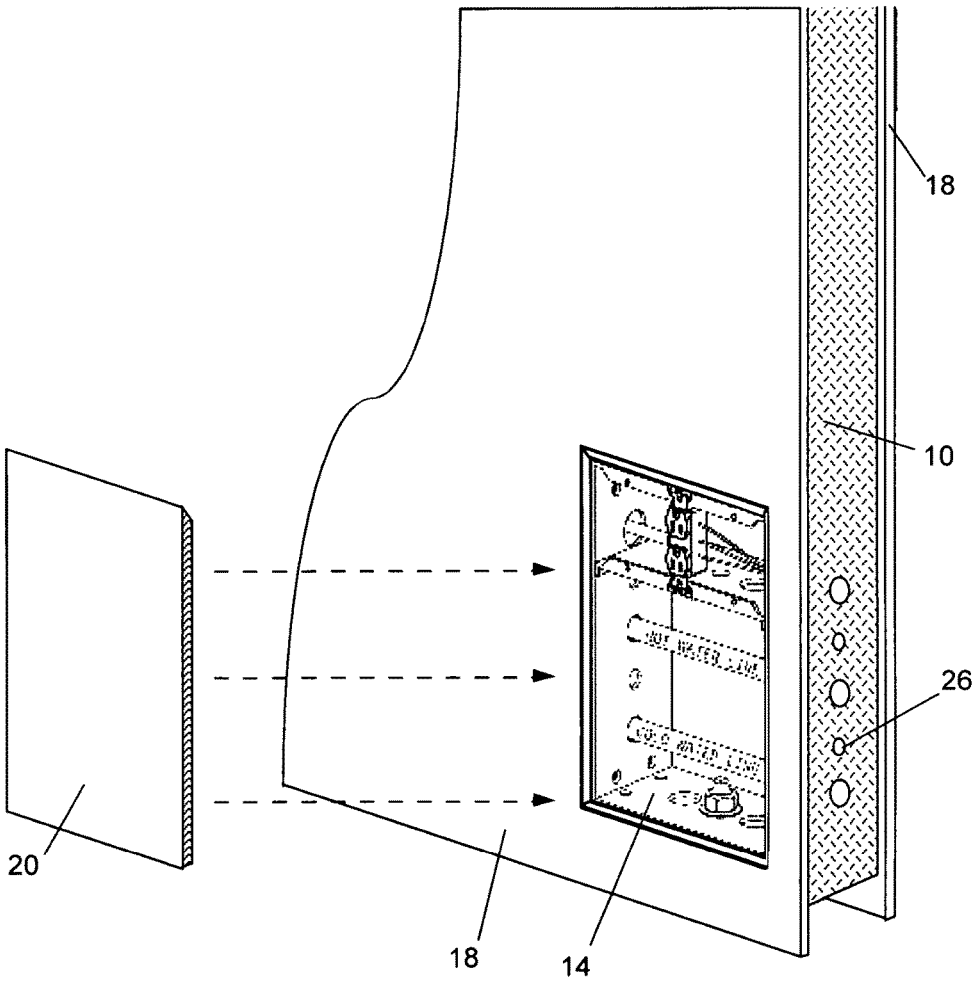
FIG. 3 is a Lower front view of the OSB beveled slot cover-corner view in the vertical position.

FIG. 3 is a Lower right front of the cut corner view of the OSB beveled slot cover-cut corner view in a vertical position provides complete configuration of how the Metal to Frame Structural Insulated Panel (M2SIP) is mounted through the Universal Receptacle base mount tie down/extra hole (34) through the green board stud and into the concrete slab and also through the right inside plate through the Structural Bolt Holes (26) to support Metal to Frame Structural Insulated Panel (M2SIP)-to-Metal to Frame Structural Insulated Panel (M2SIP). The OSB beveled slot cover is then is glued and nailed into place to connect and cover the opening of the Universal Receptacle to the Metal to Frame Structural Insulated Panel (M2SIP).

Figure 4:
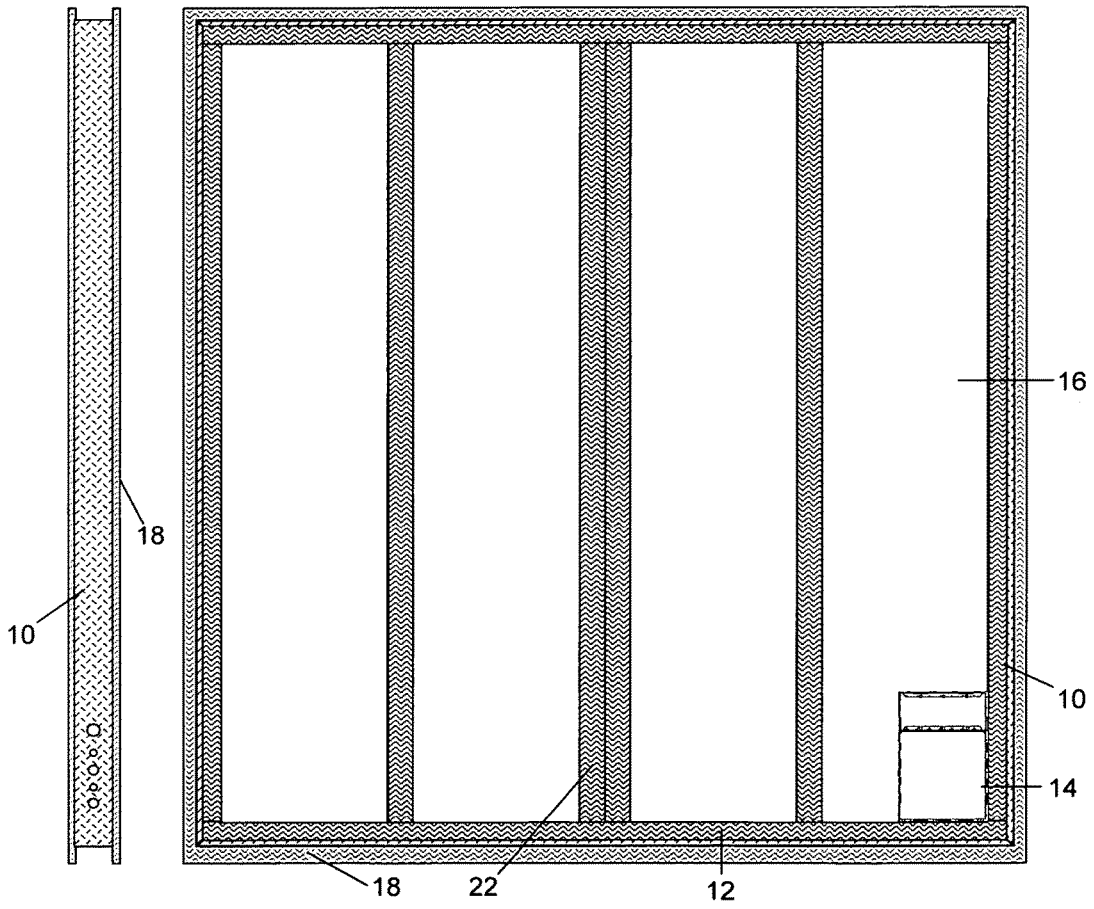
FIG. 4 is a front view of the framed system from the flat side in the vertical position.

FIG. 4 is a front view of the framed system from the flat side in a vertical position. This provides an integrated view of the Metal to Frame Structural Insulated Panel (M2SIP) when it is configured together after manufacturing. Each component of the Metal to Frame Structural Insulated Panel (M2SIP) is designed to give the structure strength, durability and stability. The steel channel frame (10), completely wraps around the structure and is spot welded at the cross section of the steel band mating. Each corner of the steel band is corner angle cut and welded together forming a complete box unit.

Figure 5:
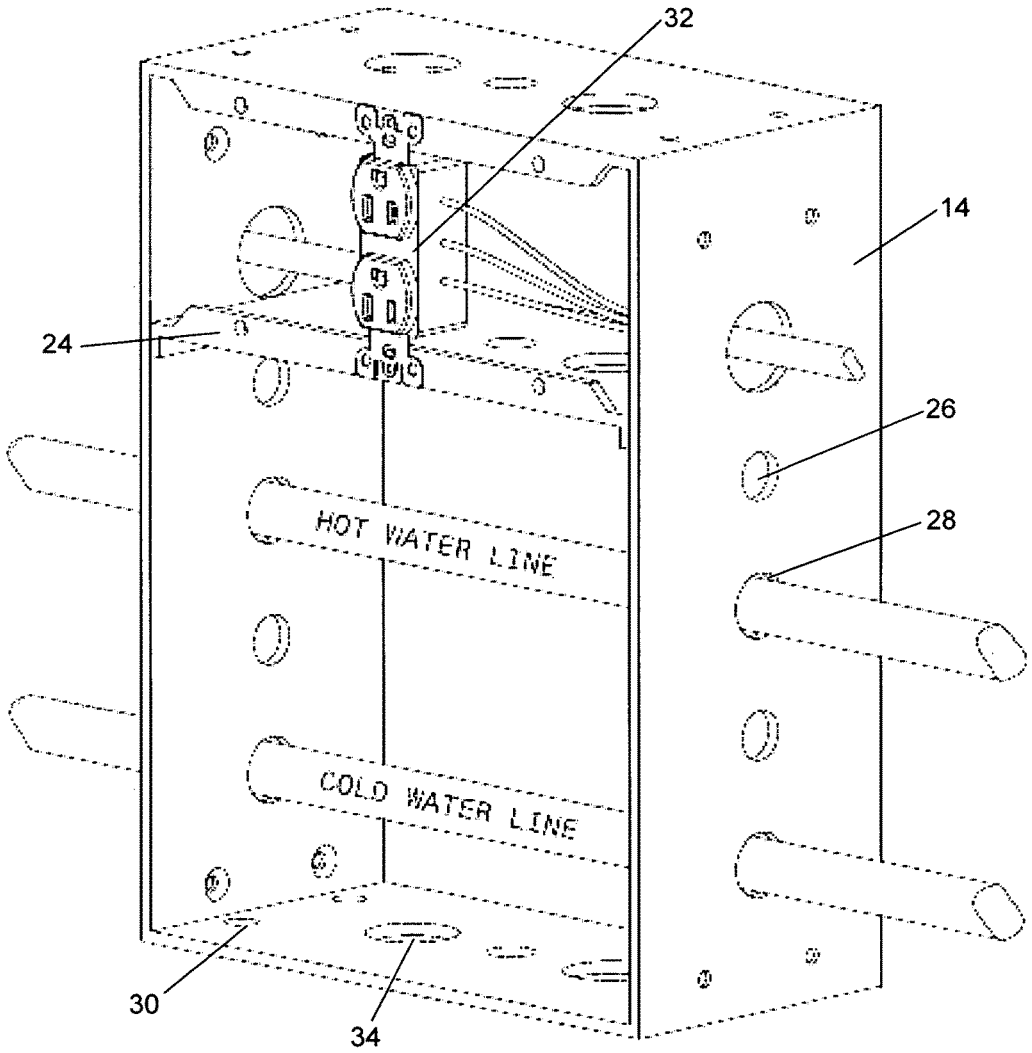
FIG. 5 is a right perspective view of a right side view of the universal receptacle, a metal utility box.

FIG. 5 is a right perspective view of a right side view of the Universal Receptacle, a metal utility box. The Universal Receptacle works in three different ways. The box has the capability to act as an electrical chase, hot and cold water line chase, base secure mounting connection and Metal to Frame Structural Insulated Panel (M2SIP)-to-Metal to Frame Structural Insulated Panel (M2SIP) structural mating unit. The Universal Receptacle is essential to the integration and deployment of the Metal to Frame Structural Insulated Panel (M2SIP) structure and is incorporated with one electrical receptacle (32). The size and dimension of the Universal Receptacle is: material thickness of 3/16$^{th}$". Openings: five perforated openings, two water openings, four bolt mounts, four screw base openings, two support base mounts, two electrical openings, and one receptacle opening. The Universal Receptacle is 13" in height, 10" wide, 5 1/16" deep with 3¾" internal cap opening, Universal Receptacle screw mount hole (30) and eight screws. Base mount tie down/extra hole (34) is connected together with a thick over sized washer and bolt to make a secure connection to the Metal to Frame Structural Insulated Panel (M2SIP) structure, to the concrete base, Metal to Frame Structural Insulated Panel (M2SIP)-to-Metal to Frame Structural Insulated Panel (M2SIP) structural bolt holes (26) and mating bolts. Each Universal Receptacle is connected to the internal wood frame (12) and utility products are then routed through the internal can of the Universal Receptacle.

Figure 6:
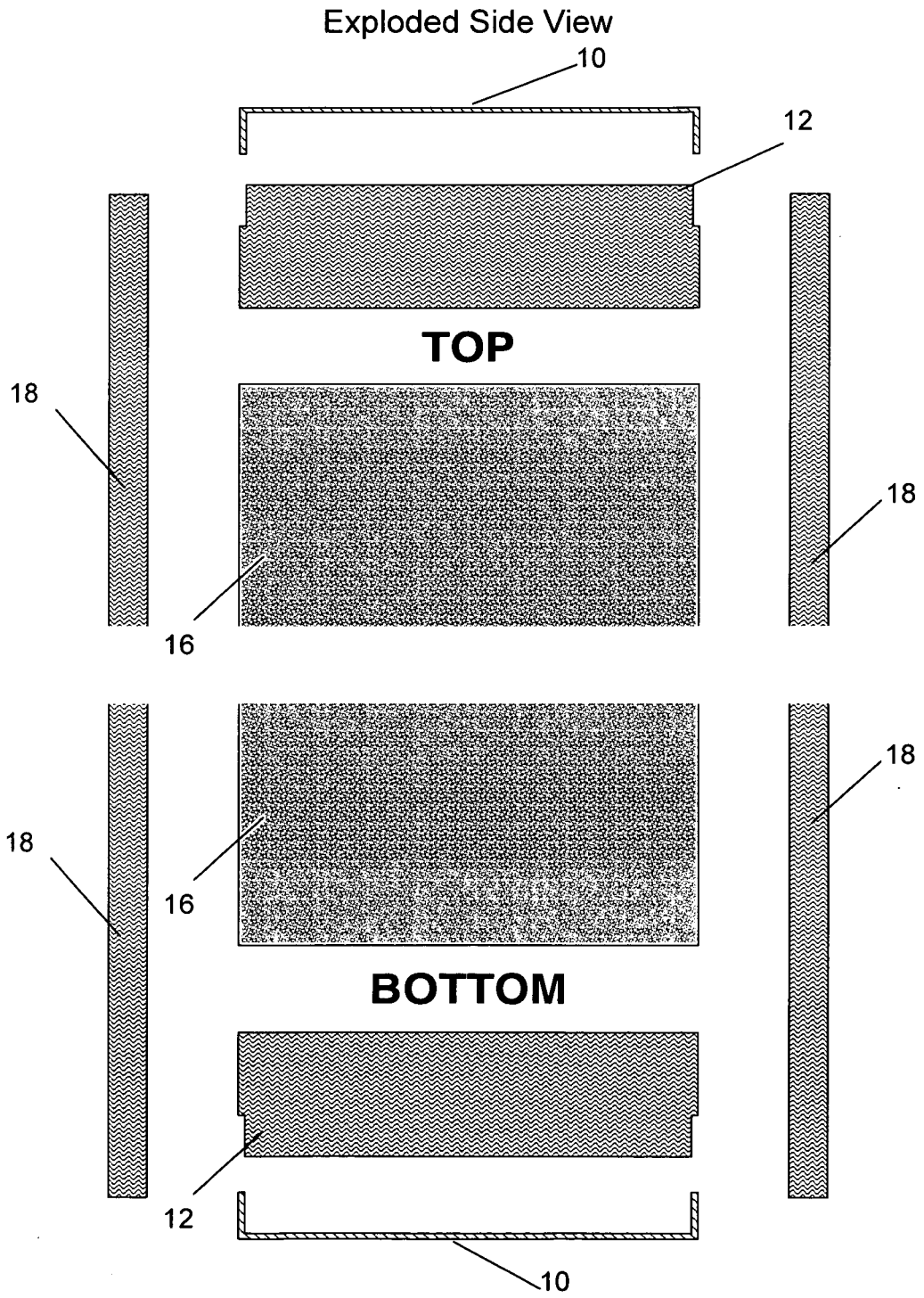
FIG. 6 is an exploded side view of a Metal to Frame Structural Insulated Panel (M2SIP) wall view diagram in the vertical position.

FIG. 6 is an exploded view of a Metal to Frame Structural Insulated Panel (M2SIP) wall diagram in the vertical position that provides a detailed description of what components are used to make up the Metal to Frame Structural Insulated Panel (M2SIP) structural wall.

Figure 7:
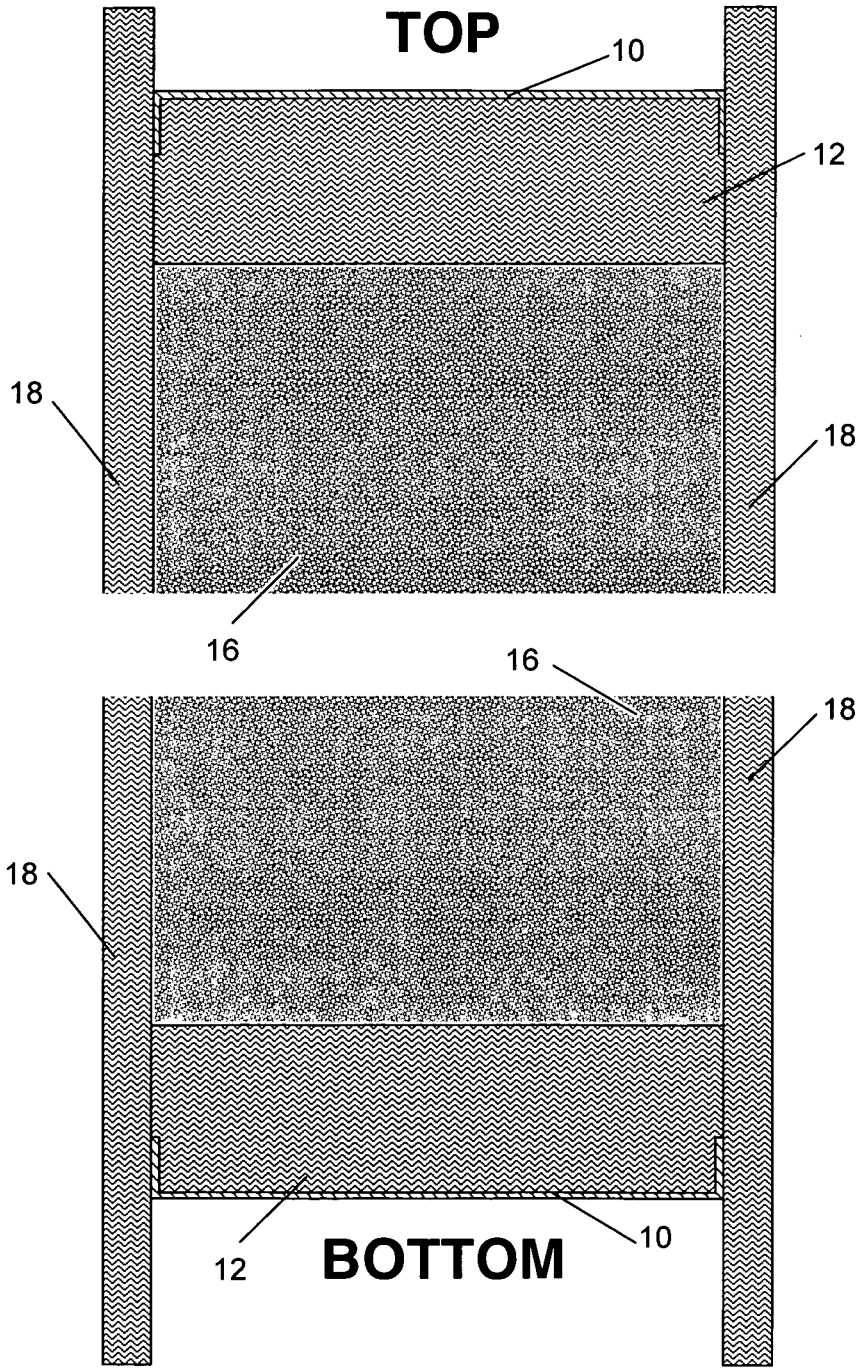
FIG. 7 is a perspective view of a Metal to Frame Structural Insulated Panels (M2SIP) wall integrated side view diagram in the vertical position.

FIG. 7 is a perspective view of a Metal to Frame Structural Insulated Panel (M2SIP) side wall diagram in the vertical position that provides a detailed description of what components are used to make up the Metal to Frame Structural Insulated Panel (M2SIP) structural wall. Each material has been listed in the top part of the method of integration build section that describes what materials are used in the manufacturing of the Metal to Frame Structural Insulated Panel (M2SIP) structural wall.

Each Metal to Frame Structural Insulated Panel (M2SIP) exterior Oriented Strand Board (OSB) shall be coated on the back of the material with a water-soluble adhesive before the Oriented Strand Board (OSB) is joined to the studs. This process provides strength in the mating process. Oriented Strand Board (OSB) (18) will be nailed to the exterior wood studs for security. This mates the glued Oriented Strand Board (OSB) (18) to the horizontal top/bottom studs and the vertical side studs together. Internal support studs must be nailed through the outside of the OSB into the exterior wood studs. Smaller secondary vertical support studs will be glued and nailed for added support to the internal support studs.

Since other modifications and changes vary to fit particular operating requirements and environments it will be apparent to those skilled in the art. The invention is not considered limited to the example chosen for purposes of disclosure, and covers all changes and modifications which do not constitute departures from the true spirit and scope of this invention.

CALL OUT INDEX

10 The Steel Channel Frame
12 The Outer Wood Frame
14 Universal Receptacle
16 Expanded Polystyrene (EPS) Foam
18 Oriented Strand Board (OSB)
20 OSB Beveled Slot Cover
22 Vertical Wood Studs
24 Electrical Chase Panel
26 Structural Bolt Hole
28 Wiring and Water Chase Hole
30 Universal Receptacle Screw Mount Holes
32 Standard Electrical Receptacle
34 Base Mount Tie Down/Extra Hole

What is claimed is:

1. A metal to frame structural insulated panel (M2SIP) for improving a building construction process and providing pre-determined stability and durability, the M2SIP comprising a prefabricated unitary wall section integrated with:

i) a rectangular outer steel c-channel frame comprising a first parallel set of form-bent lips extending from a top side of the frame toward a center of said frame and from a bottom side of the frame toward the center of said frame, a second parallel set of form-bent lips extending from left and right sides of the frame toward the center of said frame, a first set of drilled openings on the bottom side of said frame, and a second set of drilled openings on at least one of the left and right sides of said frame;

ii) a plurality of horizontal and a plurality of vertical wood studs integrated with said frame, wherein a first horizontal wood stud of the plurality of horizontal wood studs is inset within and runs a full length of the first parallel set of form-bent lips extending from the top side of said frame, wherein a second horizontal wood stud of the plurality of horizontal woods studs is inset within and runs a full length of the first parallel set of form-bent lips extending from the bottom side of said frame, and wherein the plurality of vertical wood studs are coupled at one end to the first horizontal wood stud and coupled at an opposite end to the second horizontal wood stud with at least two of the plurality of vertical wood studs inset within the second parallel set of form-bent lips extending from the left and right sides of said frame;

iii) a universal receptacle integrated into a corner about a top or bottom and left or right side of said prefabricated unitary wall section, the universal receptacle having pre-drilled holes, the universal receptacle being a metal utility box including an electrical chase and water lines;

wherein a base structure of the M2SIP is secured to a concrete foundation;

wherein portions of the plurality of horizontal wood studs are mitered with a first set of at least two openings in the second horizontal wood stud aligning with the first set of drilled openings about the bottom side of said frame;

wherein portions of the plurality of vertical wood studs are mitered with a second set of at least two openings in a particular vertical wood stud from the plurality of vertical wood studs aligning with the second set of drilled openings about said frame, the second set of at least two openings corresponding to openings for said electrical chase and said water lines; and iv) first and second sets of bolts, the first set of bolts passing through the first set of at least two openings in the second horizontal wood stud and the drilled openings about the bottom side of said frame in securing said M2SIP to the concrete foundation, and the second set of bolts passing through the second set of drilled openings in securing the M2SIP to a different adjacent M2SIP.

2. The M2SIP of claim 1, wherein the universal receptacle is attached to a lower right corner of the M2SIP;

wherein the universal receptacle is secured through the base structure of the M2SIP; and wherein the universal receptacle is anchored into the concrete foundation.

3. The M2SIP of claim 1 further comprising expanded polystyrene (EPS) foam providing soundproofing and insulation; and external oriented strand boards attached to the plurality of vertical wood studs and covering each of an interior face and an exterior face of said M2SIP.

4. The M2SIP of claim 3, wherein the EPS foam is disposed in spaces between the plurality of vertical wood studs.

5. The M2SIP of claim 3, wherein the external oriented strand boards contact said frame, the plurality of vertical wood studs, and the EPS foam.

6. A metal to frame structural insulated panel (M2SIP) providing a prefabricated integrated construction material for rapidly erecting walls, the M2SIP comprising an internal oriented strand board attached to and covering an interior face of the prefabricated integrated construction material;

a steel channel frame attached to the internal oriented strand board about one side, the steel channel frame having a top band, a bottom band parallel to the top band, and two vertical bands perpendicular to the top band with top ends of the two vertical bands being connected to the top band and bottom ends of the two vertical bands being connected to the bottom band, the top band having a top c-channel including a first top lip and a second top lip, and the bottom band having a bottom c-channel including a first bottom lip and a second bottom lip;

a universal receptacle integrated in a corner of said steel channel frame, said universal receptacle comprising an electrical chase and water lines;

a wood frame having (i) a top horizontal stud inset between the first top lip and the second top lip and attached to the top c-channel, (i) a bottom horizontal stud inset between the first bottom lip and the second bottom lip and attached to the bottom c-channel, and (iii) a plurality of vertical studs attached at one end to the top horizontal stud and attached at an opposite end to the bottom horizontal stud with at least two of the plurality of vertical wood studs attached to the two vertical bands;

expanded polystyrene foam insulating chambers between the plurality of vertical studs; and an external oriented strand board attached to and covering an exterior face of the prefabricated integrated construction material, wherein the internal and external oriented strand boards retain the expanded polystyrene foam within the prefabricated integrated construction material.

7. The M2SIP of claim 6, wherein each of the two vertical bands has a vertical c-channel; and wherein a portion of a respective vertical stud of the plurality of vertical studs is in the vertical c-channel of said each of the two vertical bands.

8. The M2SIP of claim 6, wherein a first surface of the first top lip and a first surface of the first bottom lip contact the internal oriented strand board; and wherein a first surface of the second top lip and a first surface of the second bottom lip contact the external oriented strand board.

9. The M2SIP of claim 8, wherein a second surface of the first top lip and a second surface of the second top lip contact the top portion of the top horizontal stud; and wherein a second surface of the first bottom lip and a second surface of the second bottom lip contact the bottom portion of the bottom horizontal stud.

10. The M2SIP of claim 6, wherein the top portion of the top horizontal stud and the bottom portion of the bottom horizontal stud are mitered;

wherein the internal oriented strand board contacts the steel channel frame, the expanded polystyrene foam and the wood frame; and wherein the external oriented strand board contacts the steel channel frame, the expanded polystyrene foam and the wood frame.

* * * * *